United States Patent [19]

Welborn

[11] 4,269,450

[45] May 26, 1981

[54] ASPHALT SHINGLE REMOVER AND DEROOFER APPARATUS

[76] Inventor: Woodrow W. Welborn, Rte. 9, Box 375, Laurel, Miss. 39440

[21] Appl. No.: 43,668

[22] Filed: May 30, 1979

[51] Int. Cl.[3] ..... E04D 15/00; A47L 11/14

[52] U.S. Cl. ..... 299/39; 180/19 R

[58] Field of Search ..... 299/37–41; 15/93 R; 51/176; 180/19 R, 6.66; 172/39

[56] References Cited

U.S. PATENT DOCUMENTS

| | | | |
|---|---|---|---|
| 755,157 | 3/1904 | Moron | 299/40 |
| 1,949,482 | 3/1934 | Libertini | 299/39 |
| 2,455,148 | 11/1948 | Traver | 172/39 X |
| 2,464,980 | 3/1949 | Kuehn | 180/19 R |
| 2,714,934 | 8/1955 | Cassady | 180/19 R |
| 2,749,103 | 6/1956 | Clemenzi | 299/39 |
| 4,009,908 | 3/1977 | Alinder et al. | 299/37 |

*Primary Examiner*—Ernest R. Purser

*Attorney, Agent, or Firm*—George R. Douglas, Jr.

[57] ABSTRACT

Apparatus for removing old, deteriorated and worn out asphalt shingles, roofing paper, tar paper and roofing tacks from roof decking prior to replacing and installing new shingles, said apparatus having an electric motor-powered, self-propelled frame 12 with motor 62 driving the frame forward and with front mounted rotary cutter heads 20 disposed from a reversely turning, rotatably driven shaft 40 for removing the shingles, and a reversing motor 16 driving the rotatably driven shaft 40 and reversing drive wheels 54. The reversing motor 16 provides drive for a flapper head 18, cutter heads 20, and shaft 40.

5 Claims, 3 Drawing Figures

ASPHALT SHINGLE REMOVER AND DEROOFER APPARATUS

CROSS-REFERENCE TO PRIOR ART DISCLOSURES

No prior anticipatory references are known regarding this invention as defined in the claims, but certain prior art references of cursory interest are:

| U.S. Pat. No. | Inventor |
|---|---|
| 1,938,108 | Morris |
| 2,718,246 | Norberg |
| 2,889,860 | Bogley |

These patents were found in U.S. Pat. Class 52, subclass 518 and Class 144, subclasses 13 and 164, inter alia. No prior art is found that suggests a construction comprising a sprocket wheel assembly for drawing a shingle remover machine across a deck or roof structure for cutting or driving a cutter head arrangement and which provides the ease of shingle removal in the manner set forth in this specification below.

BRIEF SUMMARY OF THE INVENTION

The present invention relates to an automatic asphalt shingle deroofer which is used for removing old worn out shingles, roofing paper and roofing tacks from roof tops of any pitch, leaving the roof decking clean and ready to install appropriate felt materials and nail on new roofing. More particularly this invention relates to deroofer apparatus self-powered and self-propelled by an electric motor, and being controlled by an operator from walking behind the machine. The deroofer self-propells itself down the pitch of the roof, being guided by the operator, removing the shingles as it goes. As the machine approaches the edge or eave of the roof the machine is tilted by the operator to reverse the motion of the machine and it is returned to the center of the roof top. This is repeated progressively across the roof until all shingles are removed from the roof.

BACKGROUND OF THE INVENTION

Prior art and background methods of removing asphalt shingles, asphalt roofing paper and roofing tacks have progressed from removing by hand these articles of shingles, paper and tacks to the process of removing them with shovels which amounts to and is equivalent to literally shoveling the shingles loose and allowing them to slide down the slope and off the roof top. While this requires the working of several laborers it has amounted to the expenditure of large sums due to inflated wages and the inflated statutory rates of minimum wage requirement, together with the cost of replacing the roof to rise rapidly and sharply. Further, it has required an excessive number of persons and workers to be present on a shingle roof and may at times be hazardous to other persons and increase abnormally the cost of insurance premiums required to conduct this sort of business

SUMMARY AND FIELD OF THE INVENTION

An object and advantage of the present invention is to provide an improved technique of removing asphalt shingles, roofing paper and shingle tacks by the use of a reduced number of persons previously required in removing shingles and the like from a roof top or roof structures.

More particularly and within the purview of the invention, the object, advantage and feature of the invention is to provide forward and reversely wheel driving machine that draws itself across a roof deck on the forward wheel for removing shingles, shingle paper and shingle tacks by a cutter head arrangement and reversing the direction on the other wheel, all of which are not found in the prior art.

Additional and further objects and advantages of the invention are to provide a mechanized arrangement that provides accelerated technique for removing asphalt shingles, roofing paper and shingle tacks without the danger of several laborers being present in a small space and for reducing the cost of replacing roofs and roofing materials.

A further object and feature of the invention is to provide a self-propelled, power-driven asphalt shingle deroofing apparatus having a cutter head with cutters positioned around a 360° circle in a manner such that no more than one cutter comes in contact with the roof decking or substructure at any one time and so that there is maintained balance and reduced vibration in operating the apparatus according to the method of the invention.

BRIEF DESCRIPTION OF THE SEVERAL VIEWS OF THE DRAWINGS

The above and other objects and advantages of the invention will become apparent upon full consideration of the following detailed description and accompanying drawings in which.

DETAILED DESCRIPTION OF THE PREFERRED EMBODIMENT OF THE INVENTION

Figure 1:
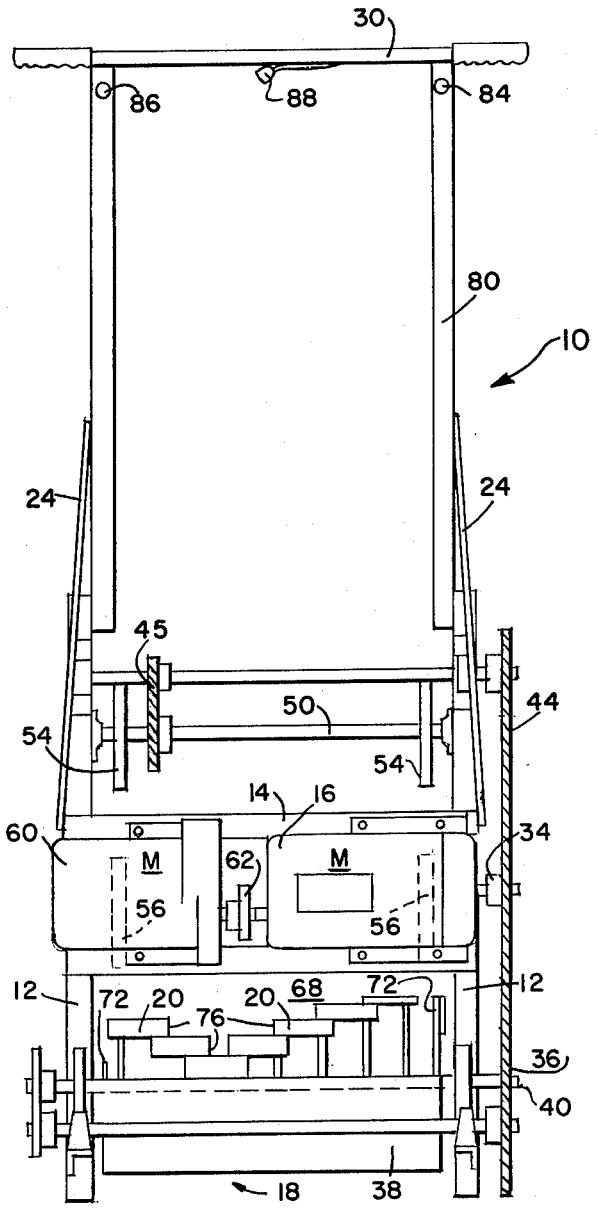
FIG. 1 is a plan view of a self-propelled power-driven asphalt shingle deroofer apparatus according to the present invention.
Figures 2, 3:
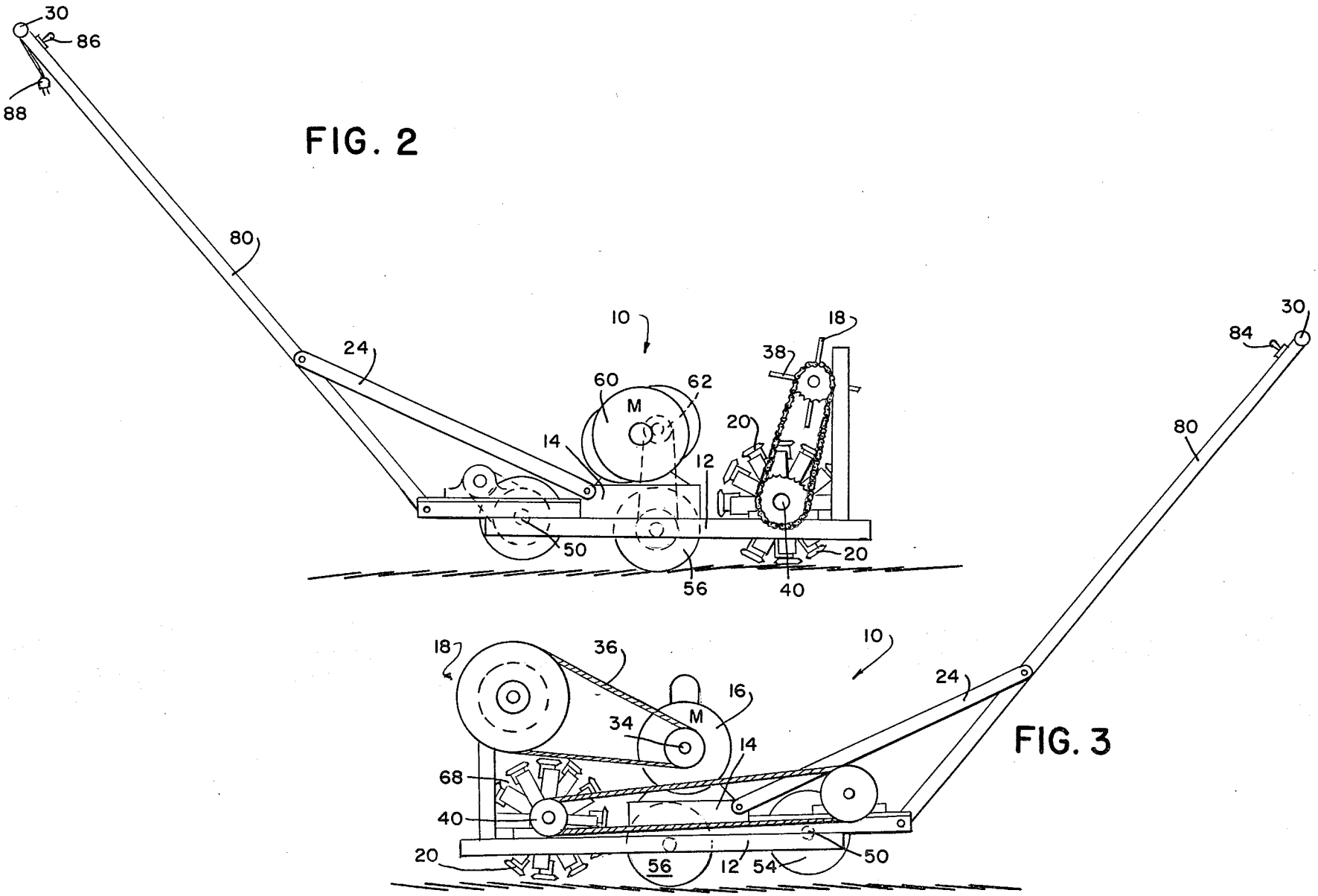
FIG. 2 is a left elevation view thereof without showing the shingles on the roof illustrated in FIG. 1.
FIG. 3 is a right elevation view thereof.

Referring now to the drawings there is shown an asphalt shingle deroofer apparatus 10 in FIGS. 1, 2 and 3 having a main frame 12 that may be of a U-shape configuration on which there is mounted in supporting relation a drive frame 14 upon which is mounted a reverse drive wheel motor 16 for a flapper head 18 and a cutter head 20. A support structure arm 24 augments and assists the structure supporting the drive frame 14 in relation to handle bar 30.

The drive wheel motor 16 is provided with a shaft 34 for driving a belt 36 which in turn drives a flapper head 18 having flappers 38 for removing shingles stuck in the cutter head 20. The flapper head 18 drives a cutter head shaft 40 for cutter head 20.

Going now to the cutter head shaft 40 it is seen that when it is driven by the motor 16, it is also mechanically coupled by a belt drive means 44 and 45 to drive shaft 50 on which is a reversely driven drive wheel 54, but is off-mounted from contacting the roof as shown until the frame is tilted as described below. A forward drive motor 60 mounted on drive frame 14 and including a speed reduction mechanism is coupled by coupler 62 to the forward drive wheels 56, 56.

At the edge of the cage or zone 68 of the cutter head 20 there is a knife edge means 76 at the forward end thereof as shown in FIG. 1 driven together with side cutter elements 72 in the cutter head. The side cutter elements are at each end of the cutter space or zone 68 shown in FIG. 1 and extends between the cutter head 20.

There is provided a handle bar 30 on arms 80 controlling the engagement of the forward drive wheels 56, 56 so that on tilting the frame 12 by handle bar 30 it is selectively tilted for disengaging forward drive wheels 56, 56 and engaging reverse drive wheels 54, 54.

Switch button and means 84 may be provided for switching OFF and ON the motor 16 for driving the cutter heads 20, the flappers 18 and the reverse drive wheels 54 while switch botton and means 86 may be provided for switching OFF and ON the motor 60 and the forward drive wheels 56. A conventional electric supply system may be connected to power cord coupler 88.

Additional embodiments of the invention in this specification will occur to others and therefore it is intended that the scope of the invention be limited only by the appended claims and not by the embodiments described hereinabove. Accordingly, reference should be made to the following claims in determining the full scope of the invention.

What is claimed is:

1. An improved asphalt shingle remover and deroofer apparatus comprising a horizontally disposed U-shaped main frame drive means mounted on opposite sides of the frame and being driven by said drive menas mechanically coupled thereto, an arrangement of a plurality of cutter heads mounted affixedly onto a rotating shaft driven by said drive means, a driven flapper reel means rotatably mounted parallel to the rotating shaft for knocking out of the way the shingles that collect and become attached to the flapper reel means, and side cutter means being additionally end mounted on the rotating shaft with the rotatably mounted cutter heads.

2. The invention according to claim 1 wherein handle bar means is provided to carry thereon a control unit panel means and toggle means for selectively operating switch means to drive and selectively control the drive wheel means.

3. The invention according to claim 2 wherein flexible power cords connect at the handle bar for the control unit panel and the frame.

4. The invention according to claim 1 wherein the cutter heads are positionally disposed about a cylindrical surface they generate and in such a manner that no more than one cutter head comes into contact with a roof decking at any one time.

5. The invention according to claim 1 wherein the forward and reverse drive wheel means includes a forward wheel continuously driven and a reverse wheel continuously drive, the apparatus being driven forward by lifting up on the handle bar for disengage of the reverse wheel and conversely.

* * * * *